US006098224A

United States Patent [19]

Gladney

[11] Patent Number: 6,098,224

[45] Date of Patent: Aug. 8, 2000

[54] PILLOW TOP MATTRESS ASSEMBLIES

[75] Inventor: Ricky F. Gladney, Fairburn, Ga.

[73] Assignee: Simmons Company, Atlanta, Ga.

[21] Appl. No.: 09/165,937

[22] Filed: Oct. 2, 1998

[51] Int. Cl.[7] ..... A47C 23/04

[52] U.S. Cl. ..... 5/716; 5/643; 5/654.1; 5/655.7

[58] Field of Search ..... 5/716, 642, 654.1, 5/655.7, 730, 722, 691; 267/80; 297/452.16, 219.1

[56] References Cited

U.S. PATENT DOCUMENTS

| | | | |
|---|---|---|---|
| 490,447 | 1/1893 | Lewis | 5/642 |
| 1,846,312 | 1/1932 | Coghlan | 5/642 |
| 4,194,254 | 3/1980 | Torrex | 297/452.16 X |
| 4,424,600 | 1/1984 | Callaway . | |
| 4,449,261 | 5/1984 | Magnusson | 5/722 |
| 4,955,095 | 9/1990 | Gerrick . | |
| 5,065,485 | 11/1991 | Zocco . | |
| 5,319,814 | 6/1994 | Dyer, Jr. . | |
| 5,414,882 | 5/1995 | Goodale . | |
| 5,428,852 | 7/1995 | Tenuta et al. . | |
| 5,475,881 | 12/1995 | Higgins et al. . | |
| 5,475,940 | 12/1995 | Mauch et al. . | |
| 5,523,144 | 6/1996 | Dyer, Jr. . | |
| 5,655,241 | 8/1997 | Higgins et al. . | |
| 5,669,093 | 9/1997 | Ogle et al. | 5/722 X |
| 5,745,940 | 5/1998 | Roberts et al. . | |

*Primary Examiner*—Terry Lee Melius
*Assistant Examiner*—Fredrick Conley
*Attorney, Agent, or Firm*—Smith, Gambrell & Russell, LLP

[57] ABSTRACT

A mattress assembly includes a mattress core formed as a unitary assembly from one or more resiliently compressible materials and defining a generally planar deck surface. A pillow top layer assembly extends coextensively with the deck surface and includes a quilt panel which forms an envelope with the core. A plurality of closely spaced coil springs are positioned within the envelope. The springs retain nearly all of the their resilience over the life of the mattress assembly, thus, providing for continued comfort to the user over an extended period of time.

12 Claims, 2 Drawing Sheets

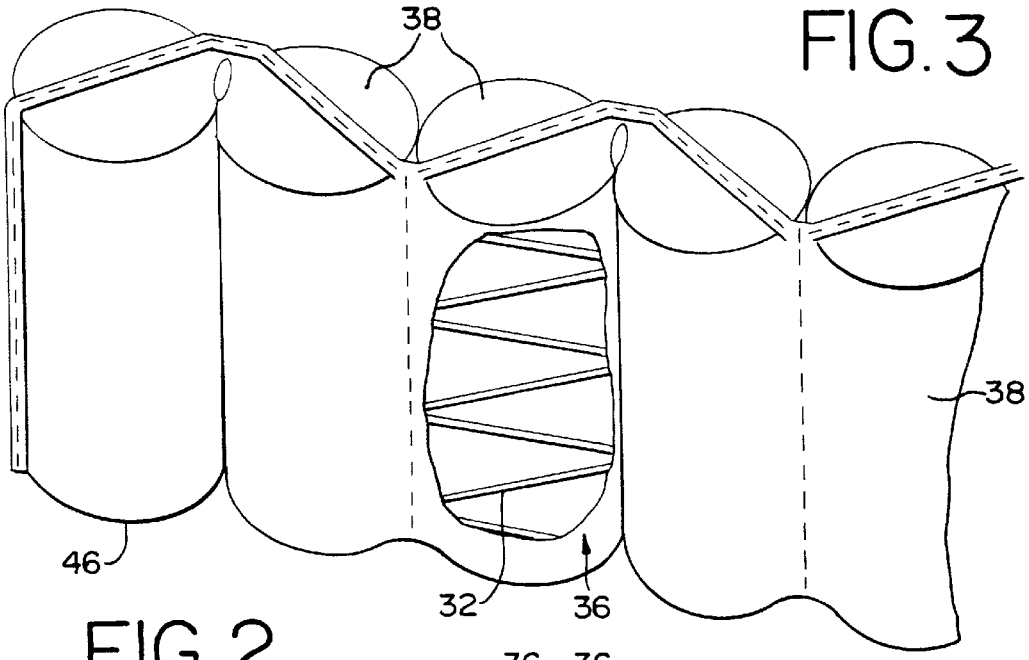
FIG. 3
FIG. 2
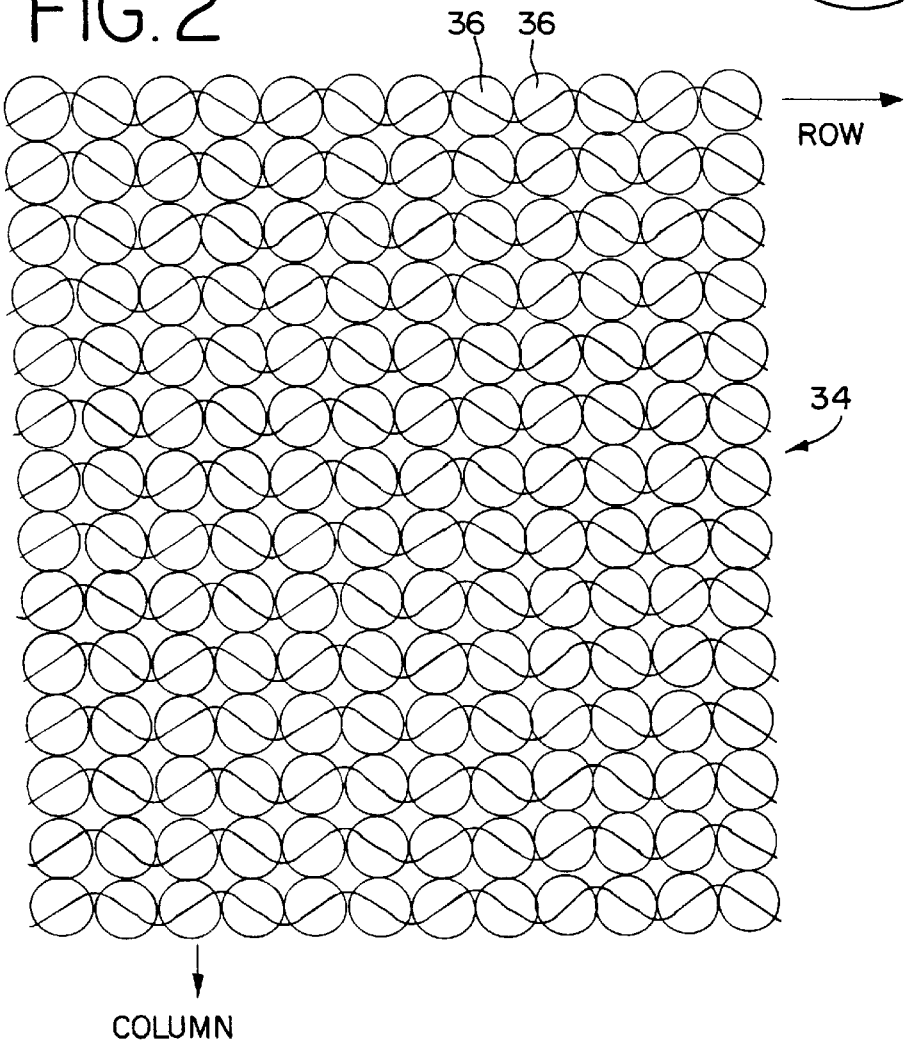

PILLOW TOP MATTRESS ASSEMBLIES

BACKGROUND OF THE INVENTION

1. Field of the Invention

The present invention relates generally to mattress assemblies and, more particularly, to new and improved mattress assemblies of the type including a pillow top construction formed in a manner to provide long lasting, resilient comfort for users of the mattress.

2. Description of the Related Art

The quality of a mattress user's sleep and the rest derived from such sleep are dependent upon the comfort of the individual lying on a sleeping surface. Accordingly, attempts to improve the comfort of mattresses have been ongoing over an extended period of time. An ideal mattress, or sleep surface, would essentially eliminate all discomfort caused by excessive pressure on the individual or improper support. Thus, one form of mattress that has become popular is of a type comprising a mattress core, which may have an innerspring construction therein together with what is known as a pillow top arrangement.

Heretofore, pillow tops for use in mattress constructions have been formed by inserting soft resilient filling materials into a sleeve or enclosure which is interconnected with a top surface of a mattress core. Normally, when an innerspring coil mattress core is employed, the pillow top construction serves to essentially cushion the innerspring coils and to allow for more independent and unrestrained articulation resulting in improved conformability and interface pressure, thus improving overall comfort levels for a user of the mattress. An example of a pillow top mattress is disclosed in U.S. Pat. No. 4,955,095 (the '095 patent). There, it is taught to use a removable or detachable pillow top which can be removed from a mattress innerspring core for cleaning. The filling material for the pillow top is disclosed as being hollow fill fibers or polyurethane foam. Alternatively, a piece of flexible resilient convoluted polyurethane foam is taught for inclusion in the pillow top construction of the '095 patent.

In other known pillow top mattress assemblies, the filling materials enclosed within the pillow top sleeve or envelope have consisted of other textile or polymeric based products, such as resin treated textile clipping pads, polyurethane foam (slab or pin cored), and/or polymeric fiber pads (e.g., polyester, polypropylene and like flexible, resilient polymeric compositions).

A significant disadvantage of these known pillow top constructions, is that the filling materials which have been employed in prior pillow tops generally will lose approximately 25% of their original thickness during the normal life of a mattress. Thus, the original comfort provided by known pillow tops diminishes with time and use as a result of the loss of resilience of the filling material.

Accordingly, it is a primary object of the present invention to provide a pillow top mattress construction in which the pillow top retains its original thickness and resilience over an extended period of time so as to remain comfortable over the full life of the mattress.

A further object of this invention is to provide pillow top constructions which can be manufactured readily by efficient, conventional methods.

A still further object is to provide a pillow top construction which is cost-effective to manufacture and will not add appreciably to the ultimate price of the mattress.

SUMMARY OF THE INVENTION

The present invention improves over the prior art by providing a mattress assembly including a mattress core formed as a unitary construction from one or more resiliently compressible materials such as innersprings, particularly of the Marshall coil type; foam pads; convoluted foam pads; air bags; water bags and the like. The top surface of the mattress core defines a generally planar deck surface. A pillow top layer is integrally or detachably positioned on the deck surface and is structured to extend substantially coextensive with the deck surface. The pillow top includes a quilt panel which forms a sleeve or envelope housing a plurality of closely spaced, miniature sized coil springs.

The miniature springs housed within the pillow top may be arranged in so called "open coil" configurations or they may be pocketed in individual compartments in accordance with Marshall coil construction techniques disclosed, for example, in U.S. Pat. No. 685,160; U.S. Pat. No. 4,234,983; U.S. Pat. No. 4,234,984; U.S. Pat. No. 4,439,977; U.S. Pat. No. 4,451,946; U.S. Pat. No. 4,523,344; U.S. Pat. No. 4,578,834; U.S. Pat. No. 5,016,305; and U.S. Pat. No. 5,621,935, the disclosure of which is incorporated herein by reference.

Preferably, the miniature sized springs for use herein will have an installed height of not greater than about 5 inches and a diameter not greater than about 3 inches. The "installed height" of the springs refers to the height of the coil after it is inserted into a pillow top sleeve or envelope either in an open coil arrangement or in a Marshall coil construction.

The miniature springs employed in the pillow tops of the present invention retain nearly all of their resistance over the life of the mattress assembly thus providing for continued comfort to the mattress user over an extended period of time.

BRIEF DESCRIPTION OF THE DRAWING

The foregoing and other novel features and advantages of the present invention will be better understood upon a reading of the following detailed description taken in conjunction with the accompanying drawings wherein:

FIG. 2 is a schematic plan view of a complete assembly of Marshall Coils for use in a pillow top mattress construction according to the present invention as illustrated in FIG. 1; and FIG. 3 is a partial perspective view, partly broken away, of the Marshall Coil spring assembly illustrated in FIG. 2.

DETAILED DESCRIPTION OF THE PREFERRED EMBODIMENT

Figure 1:
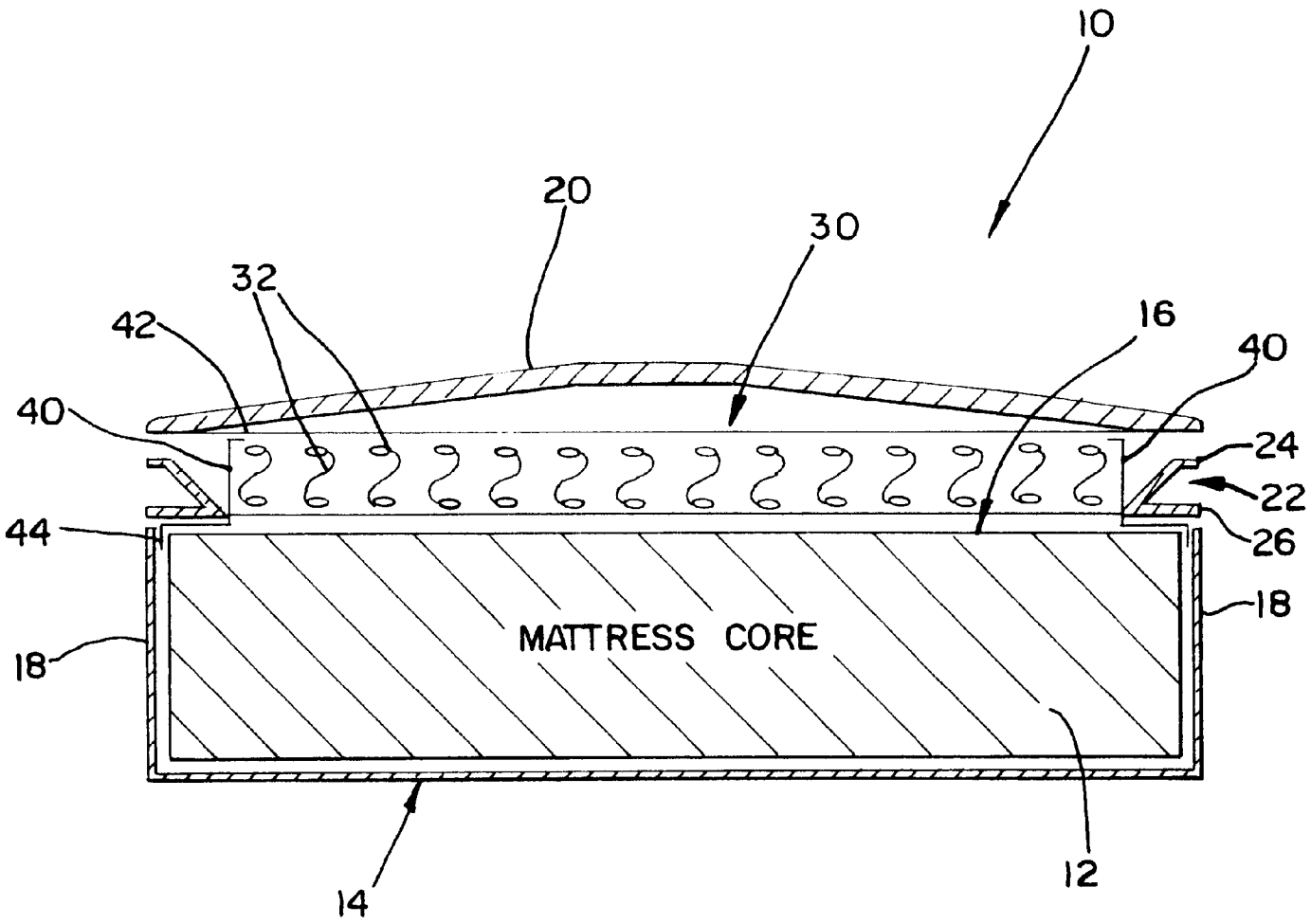
FIG. 1 is a side, schematic view of a mattress assembly constructed in accordance with the present invention including a pillow top arrangement with miniature open coil springs housed within a pillow top enclosure affixed to a mattress core.

Referring now to the drawings and initially to FIG. 1, a mattress assembly is illustrated in schematic form and designated generally by the reference numeral 10. The assembly 10 includes as a principal component a mattress core 12 which may be constructed of a variety of resiliently compressible materials such as an innerspring coil assemblies or foam such as convoluted foam pads. The core 12 also may be formed of an air or water bag. A preferred form of core 12 may be of a type referred to as Marshall construction consisting of a plurality of coil springs housed within fabric pockets arranged in a closely packed connected array as will be described hereinafter. The mattress core 12 is constructed to define a bottom deck 14 and an upper deck 16 preferably with a fabric border 18 extending around the periphery of the core 12.

The illustrated mattress assembly 10 is of a type having a pillow top construction. To this end, a quilt panel 20 is provided which is coextensive with upper deck 16. A V-shaped flap 22 is provided having a first edge 24 which is sewn to the quilt panel 20 and a second edge 26 which is sewn to the upper deck 16 thereby defining an envelope or sleeve 30 between the quilt panel 20 and the upper deck 16. In accordance with the invention, the envelope 30 is filled with a plurality of closely positioned coil springs 32. The springs 32 may be assembled as a unit much like a conventional open coil innerspring assembly schematically illustrated in FIG. 1. Preferably, the springs 32 are aligned in a spring assembly 34 illustrated in FIG. 2 wherein individual springs 32 are each encapsulated within a pocket 36 of fabric material 38 (best illustrated in FIG. 3) which may be sewn or ultrasonically welded to create the pockets 36 and to create a unitary Marshall coil type assembly 34. An example of such construction is more fully disclosed in U.S. Pat. No. 5,621,935 which is assigned to the common assignee herein and the disclosure of which is incorporated herein by reference.

In order to properly align and position the springs 32, a flange member 40 shown in FIG. 1 may be provided which is formed from a fabric such as DUON. The flange member 40 has an upper edge 42 which is connected around the periphery of the springs 32 as by attachment of C-clips (not shown) to the coil convolutions of the springs 32. A bottom edge 44 of the flange member 40 may simply be sewn to the deck 16 with the flap 22. Alternatively, the flange 40 may be eliminated and the springs 32 in a Marshall coil type assembly 34 may be properly aligned and positioned within the envelope or sleeve 30 by affixing the bottom portion 46 of the assembly 34 directly to the upper deck 16 of the core 12 in any appropriate manner such as by gluing the fabric 38 of the pockets 36 along the bottom portion of the assembly 34 to the upper deck 16 of the mattress core 12.

To construct one embodiment of the mattress assembly 10, an innerspring core 12 is formed together with the border 18. The flange 40 is then sewn to the upper deck 16 and the V-shaped flap 22 is attached to the border 18, for example, by a taped closing seam. Next, the coil springs 32 in an open coil arrangement are positioned and centered on the deck inside the flange 40. The upper edge 42 of the flange 40 is attached to the springs 32. Finally, the quilted panel 20 is positioned over the springs 32 and attached to the edge 24 of the flap 22 by a sewn taped seam.

In an alternate embodiment of this invention, the mattress assembly 10 is constructed by positioning and centering a Marshall coil assembly 34 on the upper deck 16 of the mattress core 12 and affixing the bottom portion 46 of the fabric 38 of pockets 36 to the upper deck 16 of the core 12, as by gluing. Then, the quilted panel 20 is positioned over the Marshall coil assembly 34 and is attached to the edge 24 of the flap 22 to enclose the assembly 34 therein.

It can now be appreciated that a mattress assembly 10 constructed according to the invention offers considerable advantages over prior art pillow top mattress constructions which used textile or polymeric based filling materials. The springs 32 according to the present invention have a much improved height recovery capability with respect to prior art constructions over the life of the mattress. For an acceptable product, it has been found that the installed height of the springs 32 either in an open coil or a Marshall coil arrangement within a pillow top should have a height not greater than about 5 inches and a diameter not greater than about 3 inches. Preferably, the dimensions of the springs 32 should be in a range of between about 1.5–3.5 inches in height and about 1.5–2.5 inches in diameter. The pillow top design may also be either one-sided or two-sided in function.

While the present invention has been described in connection with a preferred embodiment thereof, it will be apparent to those skilled in the art that many changes and modifications may be made without departing from the true spirit and scope of the present invention. Accordingly, it is intended by the appended claims to cover all such changes and modifications as come within the spirit and scope of the invention.

What is claimed is:

1. A mattress assembly comprising:

a mattress core formed as a unitary assembly of an innerspring coil assembly and having a generally planar deck surface;

a pillow top layer assembly being substantially coextensive with said deck surface and comprising a quilt panel forming an envelope in cooperation with said core;

a plurality of closely positioned coil springs substantially filling said envelope;

a flange formed of fabric extending around said deck surface and having a first edge secured to said deck surface and a second edge secured to said coil springs; and a V-shaped flap extending around said entire deck surface and having a first edge secured to said deck surface and a second edge secured to said quilt panel.

2. The mattress assembly of claim 1 wherein said second edge of said flange is secured to said innerspring coil assembly by C-rings.

3. The mattress assembly of claim 1 wherein said coil springs have dimensions in a range of between about 1.5 inches and 2.5 inches in diameter.

4. The mattress assembly of claim 1 wherein said coil springs have dimensions in a range of between about 1.5 inches and 3.5 inches in height.

5. A method of constructing a pillow top mattress assembly comprising the steps of:

providing a mattress core having a fabric border surrounding an edge thereof and defining an upper deck;

providing a V-shaped flap and attaching said flap by a taped closing seam to said border;

providing a unitary assembly of coil springs and placing said assembly on said upper deck within the flap;

providing a quilt panel which is coextensive with said spring assembly and positioning said panel over said spring assembly; and attaching said panel to said edge of said flap to enclose said unitary assembly of coil springs between said panel and said core.

6. The method of claim 5 wherein said unitary assembly of coil springs is constructed of a plurality of individual fabric pocketed springs in a Marshall coil type arrangement.

7. The method of claim 6 including the steps of affixing said Marshall coil type arrangement of coil springs to the upper deck of said mattress core.

8. The method of claim 7 wherein said Marshall coil type arrangement of coil springs is affixed to the upper deck of the mattress core by gluing a bottom portion of the Marshall coil type arrangement to the upper deck.

9. The method of claim 5 including the steps of:

providing a flange which extends around the periphery of the upper deck; and attaching said flange to the upper deck.

10. The method of claim 9 including the step of attaching an edge of said flange to said springs.

11. The method of claim 10 wherein said unitary assembly of coil springs is constructed of individual fabric pocketed springs in a Marshall coil type arrangement.

12. The method of claim 10 wherein said unitary assembly of coil springs is constructed in an open coil arrangement.

* * * * *